US010206850B2

(12) United States Patent
Dunn et al.

(10) Patent No.: US 10,206,850 B2
(45) Date of Patent: Feb. 19, 2019

(54) VIBRATION DEVICE AND METHOD OF INSTALLATION THEREOF

(71) Applicant: Munchkin, Inc., Van Nuys, CA (US)

(72) Inventors: Steven Bryan Dunn, Beverly Hills, CA (US); Katharine Gray Buford, Santa Monica, CA (US); Andrea Beatriz Montes, Los Angeles, CA (US); Huisok Pyon, Paramount, CA (US)

(73) Assignee: Munchkin, Inc., Van Nuys, CA (US)

( * ) Notice: Subject to any disclaimer, the term of this patent is extended or adjusted under 35 U.S.C. 154(b) by 662 days.

(21) Appl. No.: 13/776,490

(22) Filed: Feb. 25, 2013

(65) Prior Publication Data

US 2013/0225913 A1 Aug. 29, 2013

Related U.S. Application Data

(60) Provisional application No. 61/602,387, filed on Feb. 23, 2012.

(51) Int. Cl.

| | |
|---|---|
| ***A61H 23/02*** | (2006.01) |
| ***A47D 9/04*** | (2006.01) |
| ***A47D 15/00*** | (2006.01) |
| ***A61H 23/00*** | (2006.01) |
| ***A61H 1/00*** | (2006.01) |

(52) U.S. Cl.

CPC ..... *A61H 23/02* (2013.01); *A47D 9/04* (2013.01); *A47D 15/00* (2013.01); *A61H 1/005* (2013.01); *A61H 23/00* (2013.01); *A61H 23/0263* (2013.01); *A61H 2201/0111* (2013.01); *A61H 2201/0134* (2013.01); *A61H 2201/0157* (2013.01); *A61H 2201/5048* (2013.01); *A61H 2201/5071* (2013.01); *A61H 2201/5097* (2013.01); *A61H 2230/505* (2013.01)

(58) Field of Classification Search

CPC ..... A47D 9/04; A47D 15/00; A61H 23/00; A61H 23/0263; A61H 1/005; A61H 2201/0134; A61H 2201/0111; A61H 2201/0142; A61H 2201/0146; A61H 2201/027; A61H 2203/0456; A61H 2203/0468; A61H 2201/5097; A61H 2201/5071; A61H 2201/5048

USPC ..... D24/211, 214, 215; 5/108, 109; D6/596, D6/601

See application file for complete search history.

(56) References Cited

U.S. PATENT DOCUMENTS 2,128,978 A * 9/1938 Akin ..... A47D 13/06 217/3 R
3,727,607 A * 4/1973 Dill ..... A61H 23/02 601/57

(Continued)

*Primary Examiner* — Colin W Stuart
*Assistant Examiner* — Douglas Y Sul
(74) *Attorney, Agent, or Firm* — Robert Z. Evora, Esq.; Christian M. Lek

(57) ABSTRACT

A portable vibration device for soothing an infant. The portable vibration device includes a vibration pad portion, a control pad connected and a neck portion. The neck portion extends between the vibration pad and the control pad. A vibration circuit is provided to control a vibration element in the vibration pad. The circuit electrically connects the control pad to the vibration pad. A cushion is provided around the vibration pad portion and a cover is disposed around the cushion and the internal components of the vibration device.

19 Claims, 7 Drawing Sheets

(56) References Cited

U.S. PATENT DOCUMENTS

| | | | | | |
|---|---|---|---|---|---|
| 4,414,727 | A * | 11/1983 | Steele | A47C 19/02 | 29/401.1 |
| 4,718,876 | A * | 1/1988 | Lee | A61M 21/00 | 446/295 |
| 5,007,410 | A * | 4/1991 | DeLaney | A47C 21/006 | 5/694 |
| 5,063,912 | A * | 11/1991 | Hughes | A47D 15/001 | 446/295 |
| 5,437,607 | A * | 8/1995 | Taylor | A61H 1/00 | 5/915 |
| 6,050,265 | A * | 4/2000 | Richardson | A61G 7/065 | 128/845 |
| 6,175,981 | B1 * | 1/2001 | Lizama | A47D 9/02 | 5/655 |
| 6,217,533 | B1 * | 4/2001 | McCambridge | A61H 23/0263 | 601/56 |
| 7,361,152 | B2 * | 4/2008 | Sanada | A61H 23/0218 | 601/46 |
| 7,931,605 | B2 * | 4/2011 | Murison | A61H 19/34 | 600/38 |
| 2007/0185420 | A1 * | 8/2007 | Nan | A61H 23/0263 | 601/72 |
| 2010/0187213 | A1 * | 7/2010 | Cheatham, II | A61F 7/007 | 219/202 |

* cited by examiner

FIG. 12A
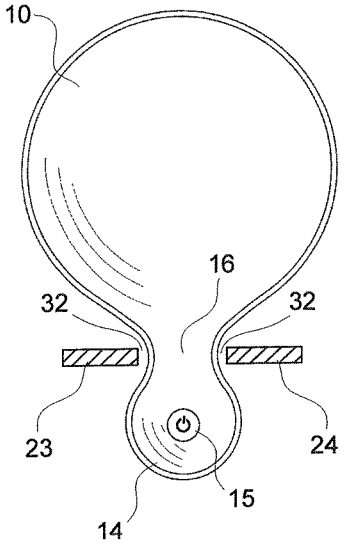
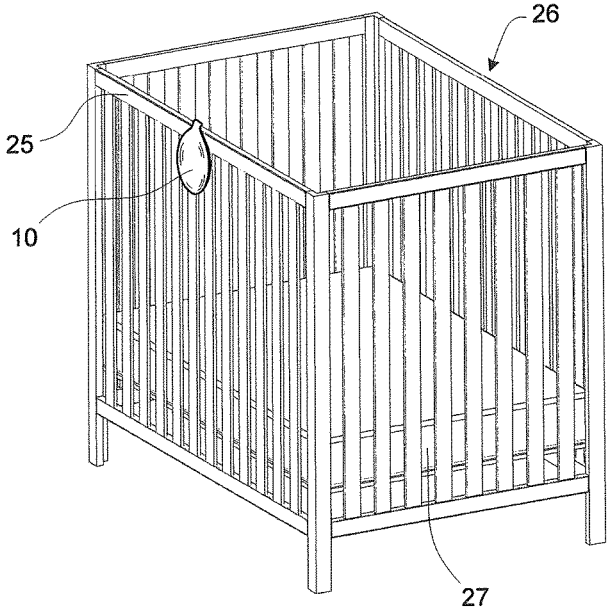
FIG. 13
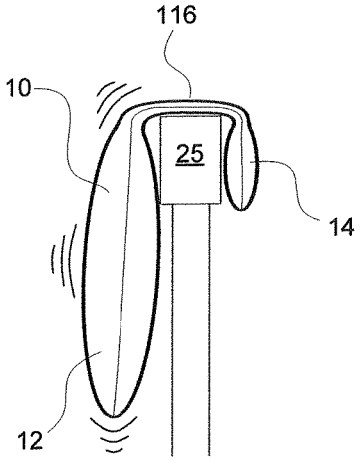
FIG. 14
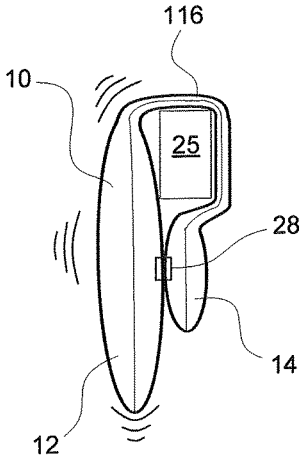
FIG. 15

VIBRATION DEVICE AND METHOD OF INSTALLATION THEREOF

CROSS REFERENCE TO RELATED APPLICATION

This application claims priority to U.S. Provisional Application Ser. No. 61/602,387 filed Feb. 23, 2013; the contents of all of which are hereby incorporated by reference herein in their entirety into this disclosure.

TECHNICAL FIELD

The subject disclosure relates to an apparatus and method for installation of a vibration device. More particularly, the present disclosure relates to installation of a flat vibration device to a portion of an infant crib and method for installing the vibration device under a mattress in the crib with minimal movement to the mattress and/or infant lying thereon.

BACKGROUND

Parents rely on the vibration in swings, bassinets, and pack-n-plays to encourage an infant to fall asleep. However, when the infant transitions from a bassinet to a crib, the parent loses the vibration she has come to rely on to soothe her infant. In times of desperation, parents have turned to various conventional solutions, such as: vibrating chair pads; vibrating elements from portable pack-n-plays; and/or the old stand-by remedy of driving the infant around in a vehicle so that the infant can be comforted by the vibrations emanating from the road.

Despite the ineffectiveness of these conventional vibration devices, a need exists for a portable efficient vibration device capable of being installed under a mattress or on the frame of an infant bed in an easy manner.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 12A shows an exemplary placement of the vibration device between a pair of adjacent slats.

FIG. 13 illustrates an exemplary method for securing the vibration device to a frame of an infant bed.

FIG. 14 illustrates a side view of the vibration device being secured to the railing of the infant bed.

FIG. 15 shows a side view of the vibration device being secured to the railing of the infant bed in an alternate manner.

DETAILED DESCRIPTION

Particular embodiments of the present invention will now be described in greater detail with reference to the figures.

Figure 1:
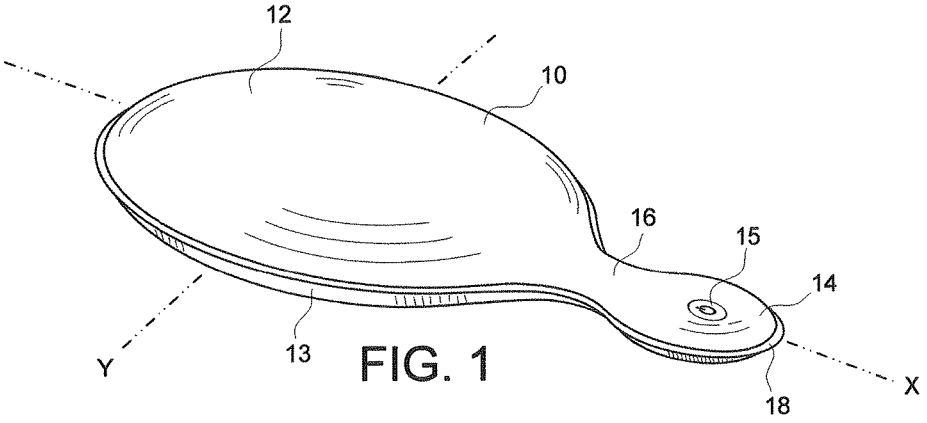
FIG. 1 illustrates a perspective view of an exemplary vibration device according to the subject disclosure.

FIG. 1 illustrates a portable vibration device 10. The vibration device 10 is configured as a flattened pad including a vibration pad 12 portion connected to a control pad 14 portion via a neck 16. The vibration pad 12 may be formed as a first larger lobe and the control pad 14 may be formed as a second smaller lobe. The first larger lobe of the vibration pad 12 may be connected by an extending neck 16 portion to the second smaller lobe of the control pad 14. As shown in FIGS. 2-5, the vibration device 10 may be constructed substantially symmetric in shape about a medial plane defined by the X-Y axis.

Figure 2:
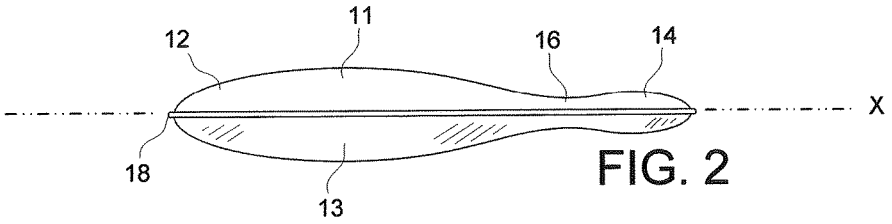
FIG. 2 shows a side view of the vibration device.

As shown in FIG. 2, an upper portion 11 and a lower portion 13 of the vibration device 10 may be embodied as a flattened clam-shell like construction. The upper portion 11 and the lower portion 13 of the vibration device 10 may be fastened at a seam 18 at their respective peripheral edges. The seam 18 may be embodied as a material built up to form a protective bumper such as shown in FIGS. 1-3, 5 and 8B. In the alternative, the seam 18 may be an attachment made by a weld, a stitching, an adhesive or the like.

Figure 3:
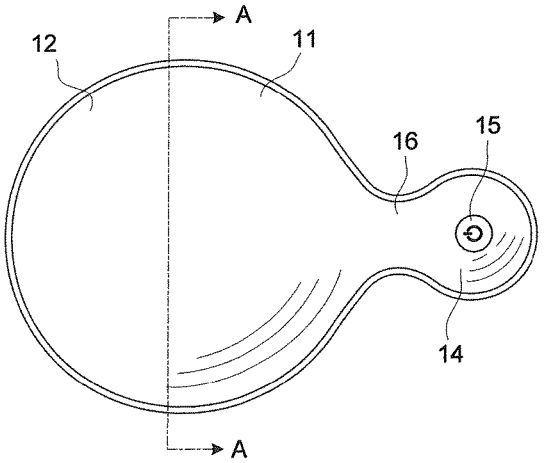
FIG. 3 depicts a front view of the vibration device.

FIG. 3 shows a front view of the vibration device 10 embodied as a paddle shaped configuration with the vibration pad 12 portion having a large curved shaped surface area. The control pad 14 portion is a smaller curved shaped surface area. The large curved shaped vibration pad 12 portion is connected to the smaller curved shaped control pad 14 portion by the neck 16. As shown, the neck 16 is sized and contoured to a predetermined narrow shaped width configuration for reason described below.

Figure 5:
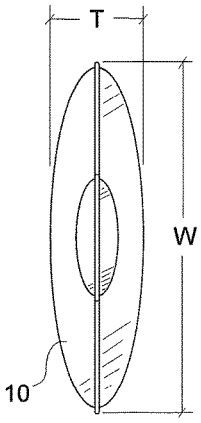
FIG. 5 shows a bottom view of the vibration device.
Figure 12:
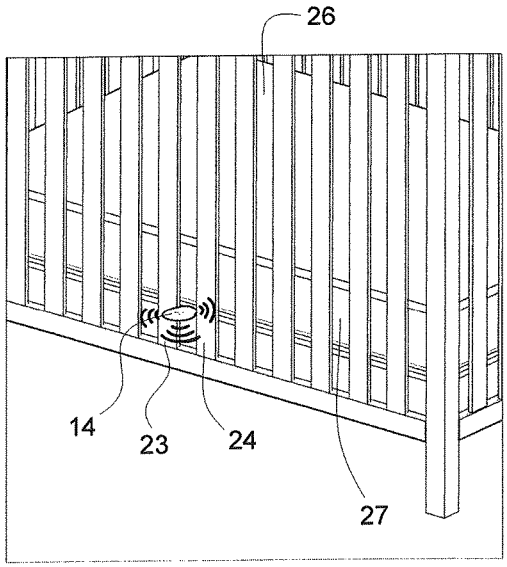

As shown in FIGS. 3 and 5, the large curved vibration pad 12 portion is constructed with a predetermined width (W) sufficient to resonate vibrations from the vibration device 10 to another surface in contact with the vibration device 10. For example, and as shown in FIG. 12 in operation, the vibration device 10 emits vibrations into a mattress 27 thereby comforting an infant lying thereon.

The smaller curved shaped control pad 14 portion is shown extending by a neck 16 to a predetermined distance outward from beneath the mattress 27 so that a user can easily access an actuator 15 in the control pad 14 portion of the vibration device 10 to activate and deactivate the vibration operation of the vibration device 10.

As shown in FIGS. 3, 9-12 and 12A, the neck 16 of the vibration device 10 is sized and contoured to a predetermined width to comfortably fit between two adjacent rungs of slats 23, 24 in an infant bed 25. Enough of a clearance gap 32 is provided between the two adjacent slats 23, 24 and the outer edges of the neck 16 of the vibration device 10. The clearance gap 32 allows a width of the neck 16 of the vibration device 10 to lie between the slats 23, 24 without coming into contact with the two adjacent slats 23, 24 to minimize vibration into the two adjacent slats 23, 24.

The axial length (X) of the neck 16 is configured to allow the control pad 14 portion to extend outward so that a user can easily access the control pad 14 portion. As will be described in more detail, the neck 16 and the control pad 14 portion is resilient and flexible enough to bend if an object should happen to bump into the neck 16 or control pad 14 portion without causing damage to the vibration device 10.

In an alternative, the neck 16 of the vibration device 10 may be configured slightly larger to securely fit, such as by a friction fit, between the two slats 23, 24. In this way, the neck 16 of the vibration device 10 can propagate vibrations and/or sounds to, or from the frame of the infant bed 25 or object that the vibration device is attached to, as well as to propagate vibrations under the mattress 27 to soothe the infant lying thereon.

It is to be understood that the portable nature of the vibration device 10 permits its use in a variety of different ways inside or outside of an infant bed. For example, the vibration device 10 may be used under a pillow or other cushion capable of providing support for a user through which the vibrations may be transmitted to the user.

It is further to be understood that the size and shape of the vibration device 10 may be substantially varied in accordance with this subject disclosure, keeping with its ability to be portably and compactly placed between adjacent slats 23, 24 and under a mattress without a user having to completely lift the mattress 27 during installation thereof. Likewise, the various components in the vibration device 10 may be attached to each other in a variety of different ways, such as but not limited to, heat welding, stitching, a hook and loop fastener, gluing with an adhesive and/or other suitable means for fastening various parts to each other.

Figure 4:
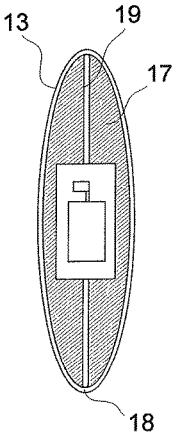
FIG. 4 illustrates a top view of the vibration device.
Figure 6:
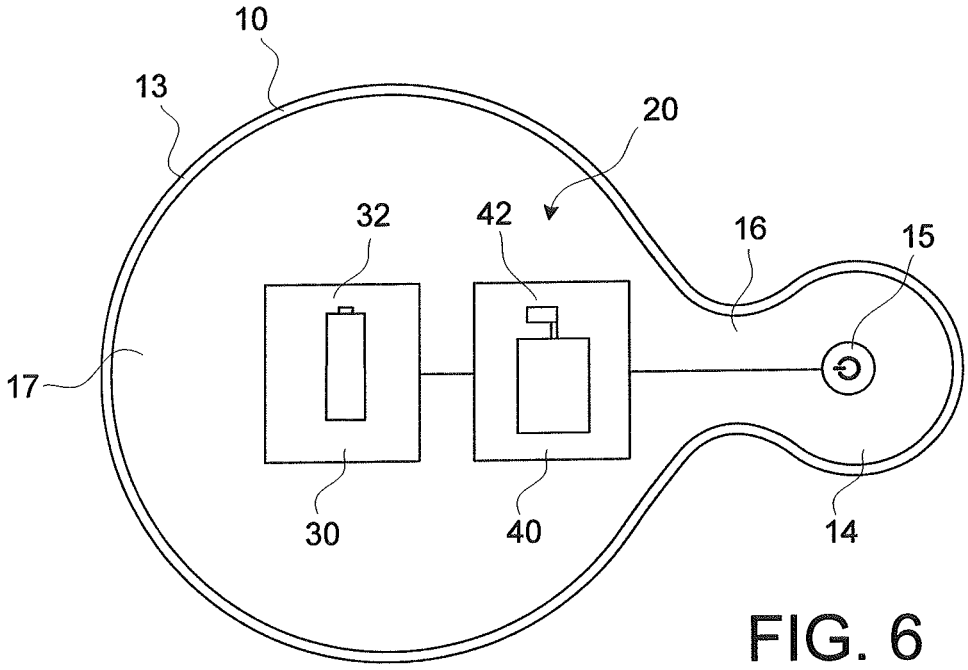
FIG. 6 depicts various internal components in the vibration device.

FIG. 4 shows an exemplary cross section along section line A-A in FIG. 3. FIG. 6 also shows in partial cross-section, the vibration device 10 including a cover 13 surrounding a cushion 17, which in turn, covers an electrical circuit 20 in the vibration device 10. The electrical circuit 20 is comprised of at least an actuator 15, a power source 30 and a vibrating motor 40 all electrically connected to each other. The electrical circuit can be arranged in a variety of different suitable configurations.

The surface cover 13 may be made of a variety of materials capable of encapsulating the inner components of the vibration device 10. The cover 13 may be made of, for example but not limited to, a stain or moisture resistant material, fibers, canvas, fabric, cotton, plastic, reinforced plastic, rubber, neoprene, fur and/or any other suitable material adapted to provide ample coverage to the interior components of the vibration device 10. The cover 13 may be made of a permeable or impermeable material. Likewise, the cover 13 may be removably interchangeable for cleaning, washing, replacement, or the like. Various designs, patterns or other indicia may be employed in accordance with the subject disclosure.

The cushion 17 may be selected from a variety of different sources, such as a compressible synthetic foam (e.g., polyurethane), a polyester fiber, a natural rubber foam material, neoprene, silicone, fibers, cotton, a woven natural or synthetic roving material, a natural or synthetic compressible foam material and/or any other suitable material capable of covering the internal components of the vibration device 10 while allowing the resonant transfer of vibrations outward from the vibrating motor 40. The cushion 17 may be selected from a material capable of dampening noise emanating from the vibrating unit 40, while maximizing the transfer of vibrations into the vibration device 10. In another alternative, a housing for the cushion 17 can be injection molded, or created by any other conventional method.

The cushion 17 may be a single piece, multiple-piece, or sectioned, having a rigid core portion adjacent to the vibrating unit 40 and a softer cushioned portion surrounding the core and internal vibrating elements. The cushion 17 itself may serve as an integral cover and cushioning element. Various pockets may be formed in the cushion 17 or the various elements inside of the vibration element 10 to provide an enclosure for insertion, and/or complete enclosure, of the various components disposed within the vibration device 10, such as the elements of the electrical circuit 20.

Figure 7:
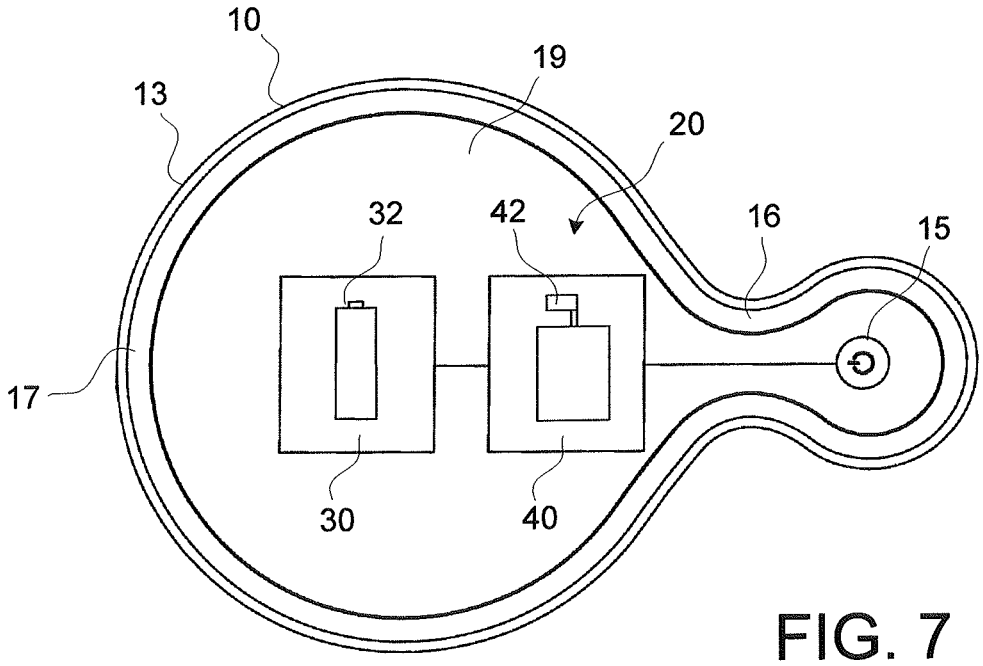
FIG. 7 illustrates another exemplary structure disposed within the vibration device.

FIG. 7 depicts an alternative embodiment in which the vibration device 10 includes a resonating member 19 adapted to transfer vibrations from the vibrating motor 40 outward through the vibration device 10. The resonating member 19 may be a separate element as shown in FIG. 7, or may be integrated as part of the material properties of the cushion 17. As a separate element, the resonating member 19 may be an inner rigid foam board, wood, a metal, plastic, hardened rubber, an alloy and/or other rigid material capable of maximizing the transfer of the vibration from the vibration unit 40 outward from the vibration device 10.

The actuator 15 in the electrical circuit 20 may be embodied as an electrical switch input that interrupts, or diverts, the current from one conductor to another. As shown, a manually operated electromechanical switch input having one or more sets of electrical contacts may be employed to allow current in the circuit to flow from the power source 30 to the vibrating motor 40.

The input mechanism actuating the transition between an open or closed state may be, for example, a "toggle" (flip switch for continuous "on" or "off"), a sliding switch or a "momentary" (push-for "on" or push-for "off") type. The actuator 15 switch may be directly manipulated by a user or initiated by a wireless remote as the control signal to the electrical circuit 20 in the vibration device 10. The actuator 15 may also be provided with a variable control mechanism capable of infinitely controlling the power flow of current in the electrical circuit 20.

The vibration device 10 may be provided with a visual indicator to show that the vibration device 10 is in an operational state, discreet vibration strength level, a predetermined vibration period, or the like. The indicator may be indicia, a color coding, an illumination source (such as an LED) or the like that provides the visual indication.

The actuator 15 may be automatically responsive to one of various other process variable inputs provided in the electrical circuit 20 to initiate the actuator 15 of the vibration device 10, such as pressure sensors, noise sensors, temperature sensors, moisture sensors, or the like as will be described in more detail later.

The power source 30 may be any conventionally known source for producing electrical energy to provide a current into the electrical circuit 20, such as a replaceable and/or rechargeable battery 32. The battery 32 in the vibration device 10 may be readily removed and replaced.

Figure 8A:
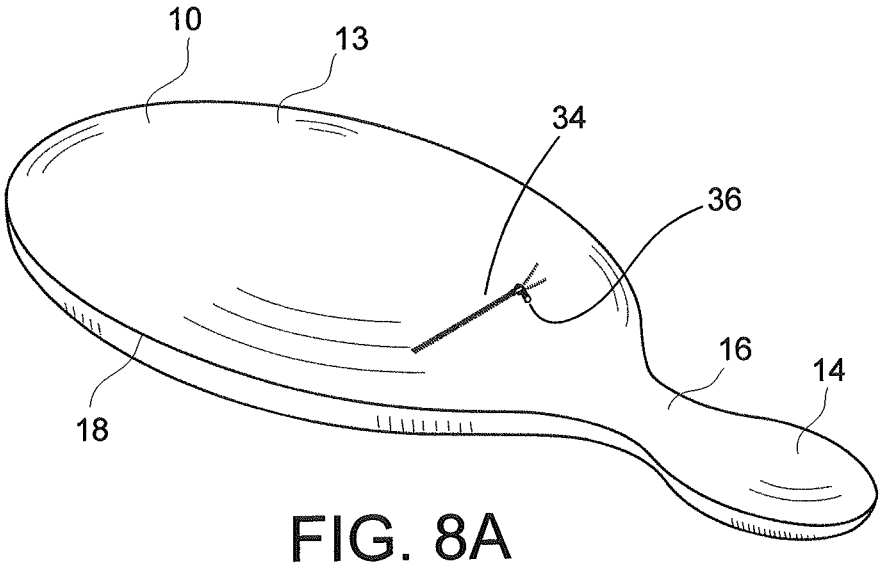
FIG. 8A shows another construction for the vibration device including a battery access panel.
Figure 8B:
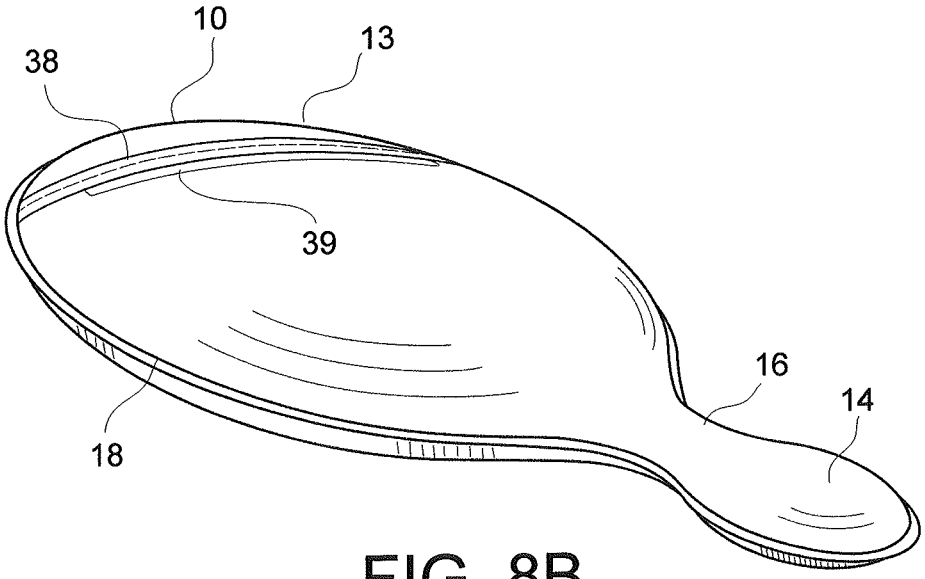
FIG. 8B illustrates yet another construction for the vibration device including a battery access panel.

For example, in FIGS. 8A and 8B, the battery may be accessed by unfastening a closure mechanism 34, such as a zipper 36 (as shown in FIG. 8A) integrated into a water resistant cover 13 of the vibration device 10, or secured by other suitable means in accordance with this subject disclosure. Alternatively, and as shown in FIG. 8B, the battery may be accessible through an overlapping panel 38 in the cover 13. The overlapping panel 38 may be secured closed by various fasteners, such as a hook and eye fastener 39 and/or any other suitable closure mechanism. The vibration pad may have the ability to be left on, or turned off by a timer, such as after 30 minutes or the like as mentioned below. Various controls may be accessed in a control panel in the control pad 14 portion.

The vibrating unit 40 may be selected from any number of conventional small vibration motors. The vibrating unit 40 may be a variable speed control motor capable of predetermined discreet settings or varied control having an infinite range of varying vibratory settings. The vibrating unit 40 comprises a small vibrating motor 42, electrically connected through the actuator 15 to a power source comprised of, one or more connected batteries 32. The vibrating unit 40, actuator 15 and power source 30 may be disposed in the various pockets provided within the cushion 17 and/or in a rigid plastic or metal housing.

In more detail, the gentle calming and soothing vibrations generated by the vibration motor 40 may be provided in a variety of different manners by the circuit 20. For example, the vibration may be a continuous vibration at a preferred vibration strength. The vibration strength may be varied among various discreet speeds or incrementally at over a preferred range. The vibration may be provided as an oscillating vibration that can be varied between predetermined output strengths. The soothing vibration may be set to operate for a predetermined period of time. The vibration strength may be varied over discreet time frames, such as 5, 15, 30 minutes, or any other preferred time period.

The strength of the vibration may incrementally adjust from a first strength to a second lower strength. For example, the vibration device 10 may begin at a predetermined strength and over time can incrementally taper off in strength over the predetermined period of time, such as 15 minutes. At the beginning of the 15 minute vibration cycle, the strength of the vibration may be provided at a first strength, and as the gentle vibration cycle continues, the strength of the vibration may diminished and stop at the end of the 15 minute cycle.

According to this subject disclosure, at least one advantage of this vibration device 10 configuration is a method of installation of the vibration device 10 under a mattress.

FIGS. 9-12 illustrate this unique method of installation. This method of installation of the vibration device 10 is different from anything conventionally available because it does not require an entire side of a mattress 27 to be lifted completely up on one side so that a space may be provided between the top rail 25 (see FIG. 13) of the vibration device 10 and the lifted side of the mattress 27. That is, removing a mattress in the conventional manner is difficult and cumbersome to a person attempting to install a vibration element under the mattress. On the contrary, the vibration device 10 of this subject disclosure eliminates this awkwardness and difficulty of lifting the heavy mattress and provides a simple method for installing the vibration device 10 under a mattress 27.

Figure 9:
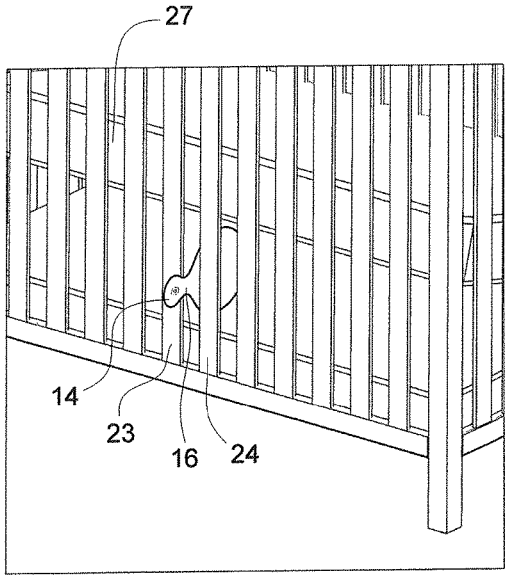
FIGS. 9-12 depict an exemplary method for installing and actuating the vibration device under a mattress.
Figure 10:
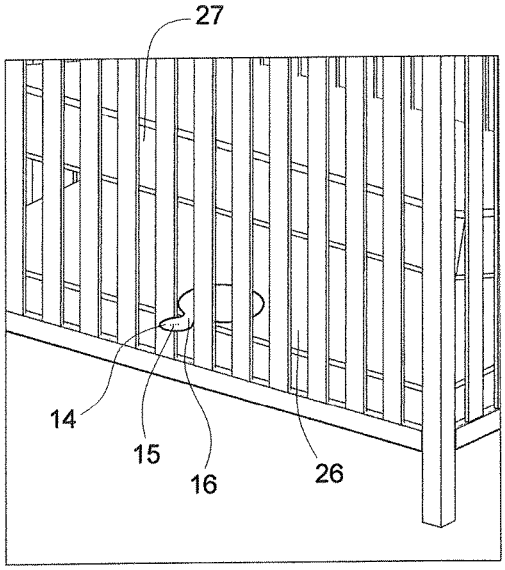

As shown in FIGS. 5 and 9, the thickness (T) of the vibration device 10 is dimension to a predetermined thickness to fit between a pair of adjacent slats 23, 24. In operation, the mattress 27 is nominally or lifted slightly (as shown in FIG. 9) just enough to push the width (W) of the vibration device sideways between the adjacent slats 23, 24 and under the mattress. That is, the vibration device 10 is turned sideways and placed through the pair of adjacent slats 23, 24 and below the mattress 27 as shown in FIGS. 9-10. One of the advantages of the design configuration of the vibration device 10 is that insertion of the vibration device 10 under the mattress 27 can be conveniently performed without disturbing an infant who may be lying on top of the mattress 27.

Figure 11:
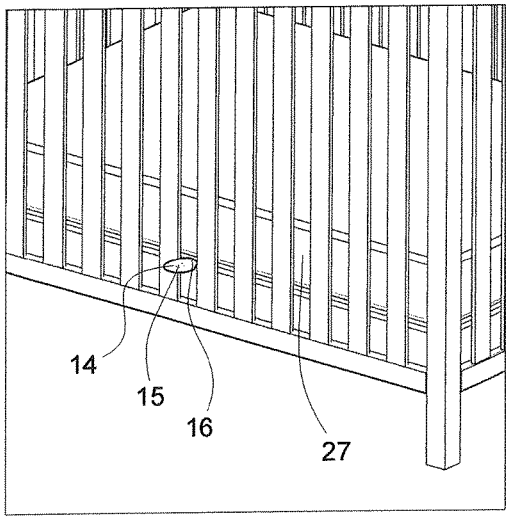

As shown in FIGS. 10 and 11, once the vibration device 10 is placed in far enough so that the neck 16 lies adjacent to the slats 23, 24 and the control pad 14 portion extends outward, the vibration device 10 is returned upright and placed flat against a lower surface 26. As shown in operable position in FIGS. 10, 11 and 12A, the neck lies adjacent to, but not in contact with, the slats 23, 24. The control pad 14 portion protrudes outward from a plane defined by the slats 23, 24 a predetermined distance so a user can easily access the actuator 15 on the control pad 14 portion for operation.

In FIG. 12, a squeezing or compression force is applied to the actuator 15 on the control pad 14 portion, which in turn, closes the circuit between the power source 30 and the vibrating unit 40. The vibrating unit 40 immediately begins to commence vibrating. The vibrations are transmitted from the vibration device 10 into the mattress 27, in a noise damped fashion. The soothing vibrations are transferred over the entire exposed surface area of the vibration device 10, and into the mattress 27 of the infant bed 17.

Upon subsequent depression of the actuator 15, the switch will open the electrical circuit 20 causing the vibrating motor 42 to cease its vibrating operation. It is to be understood that the actuator 15 may be adapted to provide various discreet vibration speed settings to the vibrating unit 40, such as for example a high, low and/or medium vibration speed and/or intensity. As mentioned previously, the vibration circuit 20 can be programmed to function in a variety of different ways. Likewise, the actuator 15 may be embodied as an adjustable switching mechanism between an on position and a maximum position capable of infinitely varying the speed of the vibrations from the vibration unit 40.

FIGS. 13 and 14 depict another exemplary method of use and installation for the vibration device 10. According to this embodiment, the vibration device 10 is shown attached to the top rail 25 of the infant bed 26. The neck 16 of the vibration device 10 is sufficiently rigid and biased into a compressed state in order to clamp onto the frame of the infant bed 26.

Although the vibration device 10 is shown with the vibration pad 12 portion lying outside of the infant bed 26, the vibration device 10 may be positioned in any preferred manner for use. It is to be understood that the vibration device 10 can be located anywhere on the infant bed 26, such as on the railing, the slats, the legs, base, and/or any other suitable location according to this subject disclosure.

As shown in operation in FIG. 14, the vibration device 10 is gripped onto the top rail 25 with such a compressive force that when the actuator 15 is activated, the vibrations from the vibrating motor 40 emanate from the vibration device 10 into the top rail 25, and into the frame of the bed and into the mattress 27 thereby soothing the infant lying in the infant bed 26.

FIG. 15 illustrates another exemplary configuration that the vibration device 10 may take in that the control pad 14 portion is capable of fully looping around the object that it is attached to and returns back to the vibrating pad 12 portion. In this construction, the neck 16 is constructed sufficiently long enough to be capable of enabling the control pad 14 portion to return back against and secured in contact with the vibrating pad 12 portion. The secured contact made between the control pad 14 portion and the vibrating pad 12 portion is made by a fastener 28. The fastener selected may be any number of various fasteners conventionally known capable of fastening the two components together, such as a hook and eye fastener, a clip, button, magnets and/or any other suitable fastening element in accordance with the subject disclosure.

Figure 16:
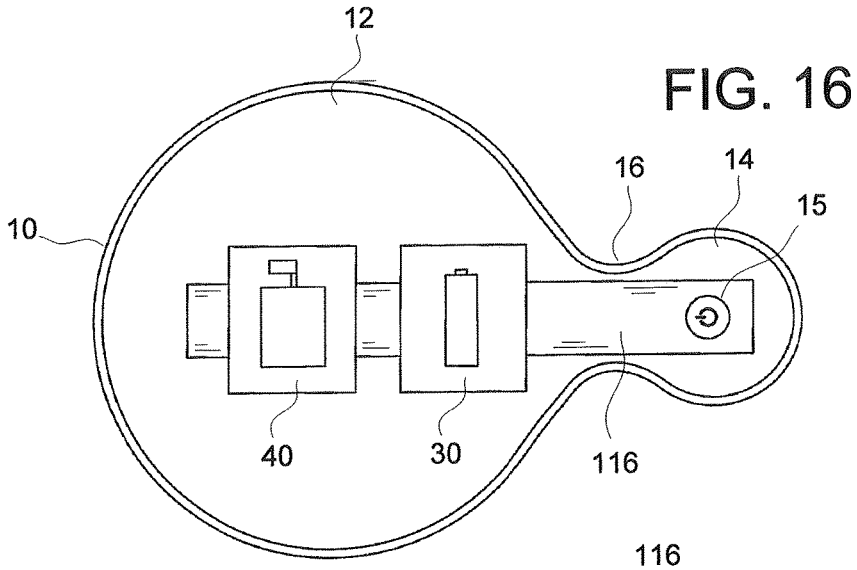
FIG. 16 depicts a flexible articulated structure disposed within the vibration device.
Figure 18:
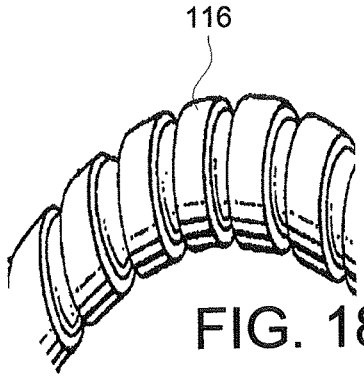
FIG. 18 illustrates an exemplary flexible articulated structure construction disposed within the vibration device.
Figure 17:
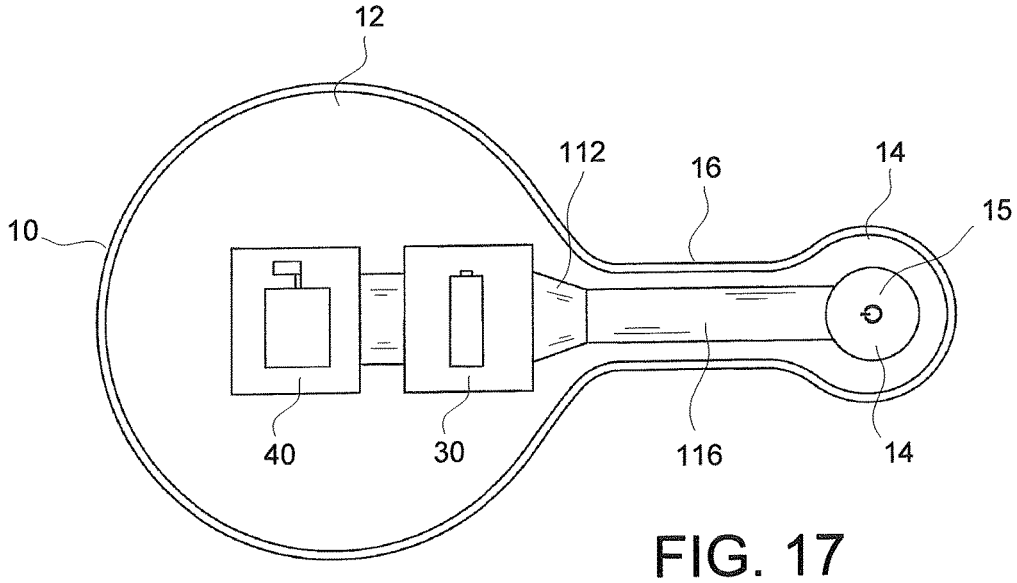
FIG. 17 shows another exemplary flexible structure having a long neck with a flexible articulated structure disposed within the vibration device.

FIGS. 16-18 illustrate in more detail the neck 16 of the vibration device 10 including an articulated element 116 that is sufficiently rigid and biased into the compressed state to clamp onto the infant bed 26. The articulated element 116 is constructed of a flexible articulated resilient connection sufficient to hold the neck 16 of the vibration device 10 in a clasped and/or clamped compressed state. Various mechanical constructions may be selected for the flexible resilient articulated element 116 construction, such as a goose-neck construction as shown in FIG. 18 and/or any other suitable friction bearing flexible connection capable of bending and clamping onto an object with a sufficient force to maximize the transmission of vibrations into the object.

In this exemplary embodiment, employing this goose-neck construction, the articulated element 116 may be moved into various configurations to clamp onto a number of different obtuse shaped objects, such as a portion of a stroller, a crib, a pack, a swing, a play-pen, and/or any other object in accordance with the subject disclosure. The wiring of the electrical circuit 20 may be disposed within the articulated element 116. In this manner, the articulated element 116 surrounds the wiring and provides a protective barrier at the bend in the neck 16.

The articulated element 116 may include a ratcheting mechanism that progressively gets tighter as the neck 16 of the vibration device 10 is further compressed onto an object. A release mechanism may be integrated to disengage the ratcheting mechanism. The articulated element 116 may be made of a variety of different materials, such as, but not limited to a polymer, a soft metal, an alloy and/or any other suitable material capable of repetitious bending and straightening with a high tolerance for fatigue.

FIGS. 16 and 17 further illustrate the articulated element 116 extending from the control pad 14 portion to the vibrating pad 12 portion. The articulated element 116 may be provided to connect the vibration unit 40, the power source 30 and the actuator 15 to each other via a substantially rigid, albeit flexible resilient frame manner. The articulated element 116 acts as an anchor to the control pad 14 portion and the vibrating pad 12 portion in such a manner that when the neck 16 of the vibration device 10 is clamped onto an object, the control pad 14 portion and the vibrating pad 12 portion will remain secure to the object and vibrations from the vibration unit 40 will resonate through the vibration device and into the object.

In FIG. 17, the neck 16 of the vibration device 10 is shown extended relative to the neck 16 shown in FIG. 16. The additional length in the neck 16 is an advantage in allowing the vibration device to conform to the construction shown in FIGS. 14-15. Referring back to FIG. 17, the articulated element 116 is shown connected at a first end to a first rigid element 114 disposed in the control pad 14 portion of the vibration device 10. At a second end, the articulated element 116 is connected to a second rigid element 112 disposed in the vibration pad 12 portion of the vibration device 10. The second rigid element 112 is provided to secure the power source 30 and the vibration unit 30 to each other. The second rigid element 112 may be substantially extended and widened to act as a resonating member. The second rigid element 112 may take a variety of different shapes and may be configured as a frame structure that partially or completely extends around the vibration pad 12 cover portion to frame the interior surface of the vibration device such as shown in FIG. 7 where the cushion 19 would be the second rigid element 112.

In use, the resilient articulated clasping element 116 is capable of grasping onto an object while providing ample rigidity to the remainder of the structure of the vibration device 10. Thus, the vibrations from the vibration unit 40 are transmitted into the vibration device 10 as it is securely attached to an object. In an alternative, the vibration device 10 may be securely fastened to an object by a secure fastener, such as a threaded fastener, a bracket mount and/or any other type of securing mechanism capable of fastening the vibration device 10 to an object. A spring loaded clamp may be employed to fasten the vibration device 10 to an object.

Figure 19:
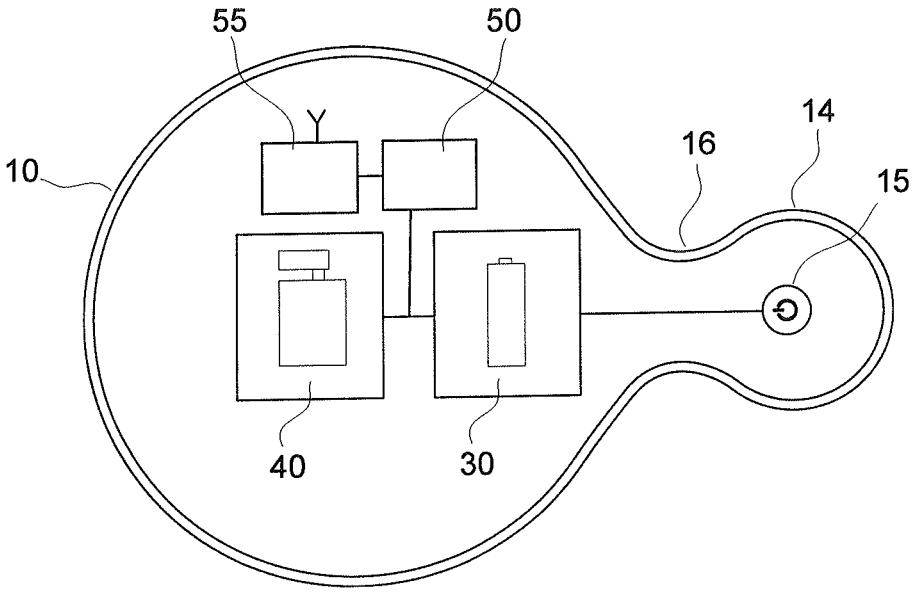
FIG. 19 depicts various additional internal components in the vibration device.

FIG. 19 illustrates another exemplary electrical circuit 120 for the vibration device 10. The electrical circuit 120 may include various other components illustrated by, but not limited to, additional elements 50 and 55. For example, the elements 50, 55 can be integrated as a programmable computer.

It is also possible to integrate various additional features and functionality in accordance with this subject disclosure. For example, the vibration device 10 may be configured as a remote baby monitor device including at least a microphone in the control pad 14 portion or elsewhere, and a transmitter capable of transmitting signals to a remote device. In this case, the elements 50, 55 may be various components comprising a computer controlled RF radio interface capable of detecting sounds, receiving and transmitting sounds.

In another example, the elements 50, 55 of the vibration device 10 may be configured as a musical box capable of playing sounds to soothe the infant, including lullabies, womb sounds, nature sounds (rain, ocean), white noise, or any other sound traditionally used to soothe an infant. A timing feature may be integrated into the vibration device 10 to transmit the sounds for a predetermined, adjustable period of time.

A voice activated control sensor may be integrated into the vibration device 10 that causes an action in response to the detection of a sound, such as actuating the vibration unit 40 upon detection of a sound. The voice detection sensor may be located in the control pad 14 portion. The sound detection can be set to cause an action in response to the detection of a decibel level reaching a predetermined level or threshold.

An illumination night light feature can be provided to operate in coordination with the electrical circuit of the vibration device 10. The illumination night light may be provided as a projection light source or a localized illumination source of light.

Various other features may be implemented, such as a moisture sensor capable of detecting when, for example, an infant has accidentally wet their bedding. Alternatively, a temperature sensor may be provided to detect the ambient temperature in the area around the infant. Likewise, movement sensors may be integrated in the vibration device 10 to react when the weight of the infant is detected on top of the vibration device 10.

The vibration device 10 may be integrated with various wireless transmitting technologies capable of transmitting the information detected by the various sensors to a remote device. The remote device may be any RF receiving device, such as a base station, a Wi-Fi, a mobile device, near field communication device and/or any other signal processing and/or receiving capable device.

This vibration device 10 is the perfect solution for parents and caregivers in that it is safe, cordless and can be taken anywhere the infant is taken. Use it under the mattress in baby's crib for nighttime soothing, or take it on trips to grandma's house for a familiar, comforting vibration to help baby fall asleep.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A portable vibration device comprising:

a vibration pad comprising a pair of flattened round halves;

a control pad comprising a pair of flattened round halves;

a flexible neck portion connecting the vibration pad to the control pad, wherein the neck portion propagates vibration and is adapted to bend such that the vibration pad and the control pad can be moved from being coplanar to being parallel with each other; and wherein the vibration pad, the control pad, and the neck portion comprise a paddle shaped configuration;

a power source that is self-contained in the portable vibration device; and a vibration circuit to control a vibration element in the vibration pad, the vibration circuit electrically connecting the control pad to the vibration pad.

2. The portable vibration device recited in claim 1, wherein the vibration circuit further comprises:

an actuator in the control pad, wherein the vibration element electrically connected to the power source and the actuator.

3. The portable vibration device recited in claim 1, wherein the vibration pad includes a cushion surrounding at least the vibration element.

4. The portable vibration device recited in claim 1, wherein the portable vibration device further comprises an opening into which the power source is accessed.

5. The portable vibration device recited in claim 4, wherein the opening is an overlapping panel that is secured closed by a hook and eye fastener on a side of the vibration device.

6. The portable vibration device recited in claim 1, wherein the vibration pad is wider than the control pad, and wherein the neck portion is narrower than the vibration pad and the control pad.

7. The portable vibration device recited in claim 1, wherein on a flat surface, the portable vibration device has a generally flat body shape configuration with a longitudinal axis along a length, having:

a thickness that is thinner than a transversal width of the vibration device relative to the longitudinal axis; and wherein, along the longitudinal axis, the vibration pad has a first lobe configuration connected by the narrowed neck portion to the control pad having a second lobe configuration that is smaller than the first lobe.

8. The portable vibration device recited in claim 1, wherein in an operable position:

the vibration pad is disposed below a mattress of an infant bed;

the neck portion extends through a pair of adjacent infant bed rail slats and a clearance distance is provided between the sides of the neck portion and the pair of adjacent bed rail slats, and the actuator in the control pad is accessible from outside of the infant bed.

9. The portable vibration device recited in claim 1, wherein the portable vibration device is inserted under an infant mattress by nominally lifting the mattress.

10. The portable vibration device recited in claim 1, wherein during installation, a mattress of an infant bed is nominally lifted and the portable vibration device is inserted sideways through a pair of adjacent infant bed rail slats and the vibration pad is slid under the mattress and positioned such that the neck portion is disposed between the pair of adjacent bed rail slats, and the actuator in the control pad extends outward beyond the slats and is accessible from outside of the infant bed.

11. The portable vibration device recited in claim 1, wherein the vibration circuit is programmable and controls a time period and/or a vibration strength of the vibration element.

12. The portable vibration device recited in claim 11, wherein the vibration circuit is programmed to gradually taper-off the vibration strength of the vibration element as an end of the time period is reached.

13. A portable vibration device comprising:

a cover surrounding:

a vibration pad comprising a pair of flattened round halves;

a control pad comprising a pair of flattened round halves;

a propagating neck portion extending between the vibration pad and the control pad, wherein the neck portion is adapted to bend such that the vibration pad and the control pad can be moved from being coplanar to being parallel with each other; and wherein the vibration pad, the control pad, and the neck portion comprise a paddle shaped configuration;

a power source that is self-contained in the portable vibration device;

a vibration circuit to control a vibration element in the vibration pad, the circuit electrically connecting the control pad to the vibration pad; and a cushion surrounding the vibration pad.

14. The portable vibration device recited in claim 13, wherein in an operable position:

the vibration pad is disposed below a mattress;

the neck portion extends through a pair of bed rails slats; and an actuator in the control pad being extended external to the pair of bed rail slats of an infant bed is accessible from outside of the infant bed.

15. The portable vibration device recited in claim 13, wherein a shape of the portable vibration device comprises:

a thickness that is thinner than a width of the vibration device; and wherein the vibration pad has a first lobe configuration connected by the narrowed neck portion to the control pad having a second lobe configuration that is smaller than the first lobe.

16. The portable vibration device recited in claim 13, wherein the vibration circuit is programmable to control a time period and/or a vibration strength of the vibration element.

17. A portable vibration device comprising:

a body having a cover surrounding:

a vibration pad configured as a first lobe comprising a pair of flattened round halves having a first radius, having a vibrating element disposed therein;

a control pad configured as a second lobe comprising a pair of flattened round halves having a smaller radius than the first lobe, and having an actuator disposed therein;

a neck portion extending between the first lobe and the second lobe, wherein the neck portion is adapted to bend such that the vibration pad and the control pad can be moved from being coplanar to being parallel with each other; and wherein the vibration pad, the control pad, and the neck portion comprise a paddle shaped configuration;

a power source that is self-contained in the portable vibration device;

a programmable vibration circuit electrically connecting the actuator to the vibrating element in the vibration pad; and a cushion disposed under the cover and surrounding at least a portion of the portable vibration device.

18. The vibration device recited in claim 17, wherein the vibration circuit is programmable to control a vibration magnitude and/or a vibration duration.

19. The vibration device recited in claim 17, wherein the cushion is comprised of foam cushioning layers that encloses the vibrating element in the vibration pad.

* * * * *